US005170173A

United States Patent [19]

Krenz et al.

[11] Patent Number: 5,170,173

[45] Date of Patent: Dec. 8, 1992

[54] ANTENNA COUPLING APPARATUS FOR CORDLESS TELEPHONE

[75] Inventors: Eric L. Krenz, Schaumburg; James P. Phillips, Lake in the Hills; Louis J. Vannatta, Crystal Lake, all of Ill.

[73] Assignee: Motorola, Inc., Schaumburg, Ill.

[21] Appl. No.: 873,850

[22] Filed: Apr. 27, 1992

[51] Int. Cl.[5] ..... H01Q 1/24

[52] U.S. Cl. ..... 343/702; 343/906; 455/347; 455/89

[58] Field of Search ..... 343/702, 866, 869, 870, 343/906, 873; 455/89, 90, 347

[56] References Cited

U.S. PATENT DOCUMENTS

| | | | |
|---|---|---|---|
| 2,315,315 | 3/1943 | Cairnes | 343/702 |
| 4,313,119 | 1/1982 | Garay et al. | 343/702 |
| 4,644,366 | 2/1987 | Scholz | 343/702 |
| 5,014,346 | 5/1991 | Phillips | 455/89 |
| 5,057,847 | 10/1991 | Vaisanen | 343/702 |
| 5,073,761 | 12/1991 | Waterman | 333/24 C |

*Primary Examiner*—Rolf Hille
*Assistant Examiner*—Hoanganh Le
*Attorney, Agent, or Firm*—Kenneth W. Bolvin

[57] ABSTRACT

The antenna coupling apparatus of the present invention couples an antenna, located in a hinged element (102) of a wireless communication device, to the receiver (401) of the device. In the preferred embodiment, the communication device is a radiotelephone. The coupling is achieved without contact or flexible cable by parallel plate capacitors (201 and 202) in the hinge of the communication device. The capacitors (201 and 202) additionally act as a matching network for the antenna.

5 Claims, 4 Drawing Sheets

ANTENNA COUPLING APPARATUS FOR CORDLESS TELEPHONE

FIELD OF THE INVENTION

The present invention relates generally to the field of communications and particularly to antenna coupling for cordless telephones.

BACKGROUND OF THE INVENTION

The conventional means for coupling signals, in portable two-way radios and pagers, between the antenna and the signal processor has been through the use of a coaxial connector found within the housing of the particular device. A difficulty exists whenever RF energy must be transferred between objects that rotate relative to one another. Sliding contacts are one solution but they have a limited life due to wear and may cause electrical noise. Flexible cables are another solution but these limit the rotation, can cause noise, and have a limited flexing life. There is a resulting need for a small, inexpensive, and reliable means for coupling RF energy between two moving parts.

SUMMARY OF THE INVENTION

The apparatus of the present invention encompasses an antenna coupling apparatus for a wireless communication device. The telephone has transceiving means for transmitting and receiving signals. The transceiving means is coupled to an antenna by the antenna coupling apparatus. In one embodiment, the apparatus is comprised of a first and second plate coupled to the transceiving means and a third and fourth plate couled to the antenna. The third plate is capacitively coupled to the first plate and separated from the first plate by a first dielectric material. The fourth plate is capacitively coupled to the second plate and separated from the second plate by a second dielectric material.

BREIF DESCRIPTION OF THE DRAWINGS

DETAILED DESCRIPTION OF THE PREFERRED EMBODIMENT

The antenna coupling apparatus of the present invention capacitively couples RF energy between a main body of an electronic device and a hinged element of the device. The coupling apparatus achieves the RF coupling without contacts or flexible cables to wear out.

Figure 1:
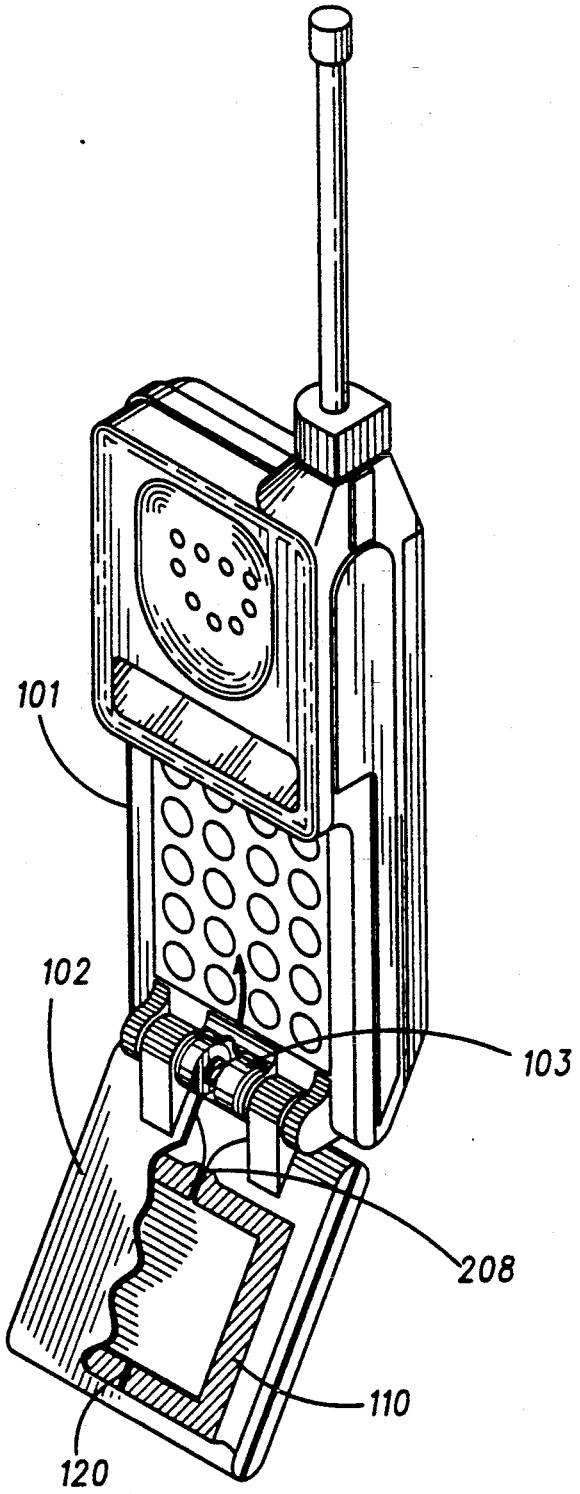
FIG. 1 shows a perspective view of a hand-held radiotelephone using the antenna coupling apparatus of the present invention.

FIG. 1 illustrates a portable radiotelephone in which the antenna coupling apparatus of the present invention can be used. The radiotelephone is comprised of a main body (101) and a hinged element (102). The hinged element (102) is attached to the main body (101) through hinges. The antenna coupling apparatus (103) is coaxially located in the hinge as shown in the cutaway portion of FIG. 1.

Figure 4:
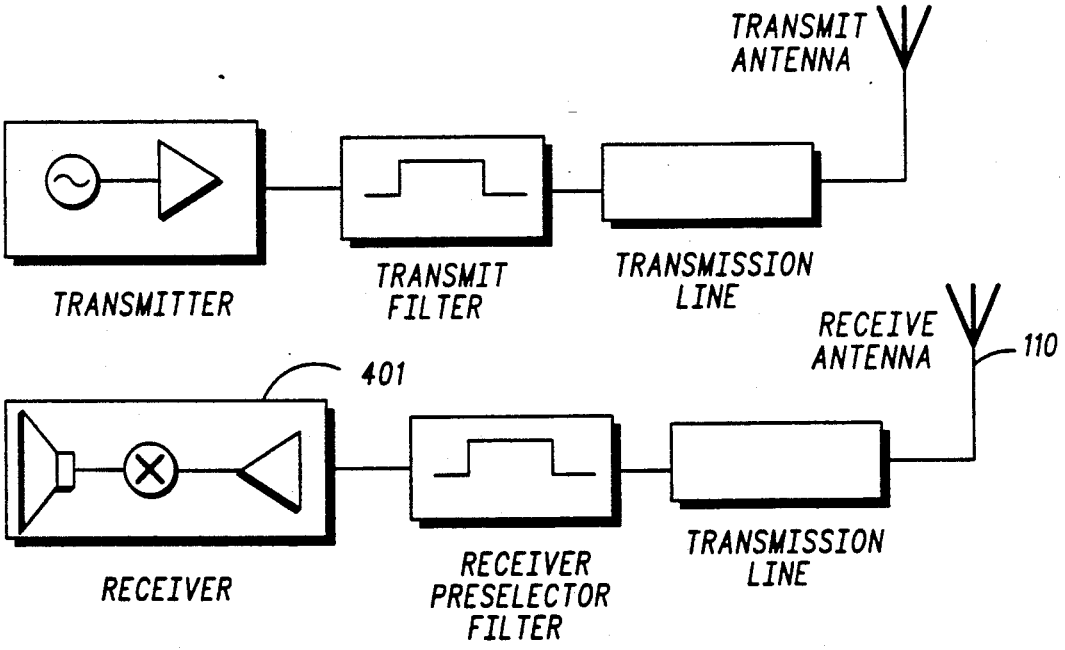
FIG. 4 shows a block diagram of a typical radiotelephone.

The main body (101) contains a receiver (401) in addition to the other electronics required by the radiotelephone. A simplified block diagram of the receiver section (401) and the other electronics is illustrated in FIG. 4. Referring again to FIG. 1, the hinged element (102) contains the antenna (110) that is coupled to the receiver (401) by the antenna coupling apparatus (103). This antenna is shown in the cut-away portion of the hinged element (102).

Figure 2:
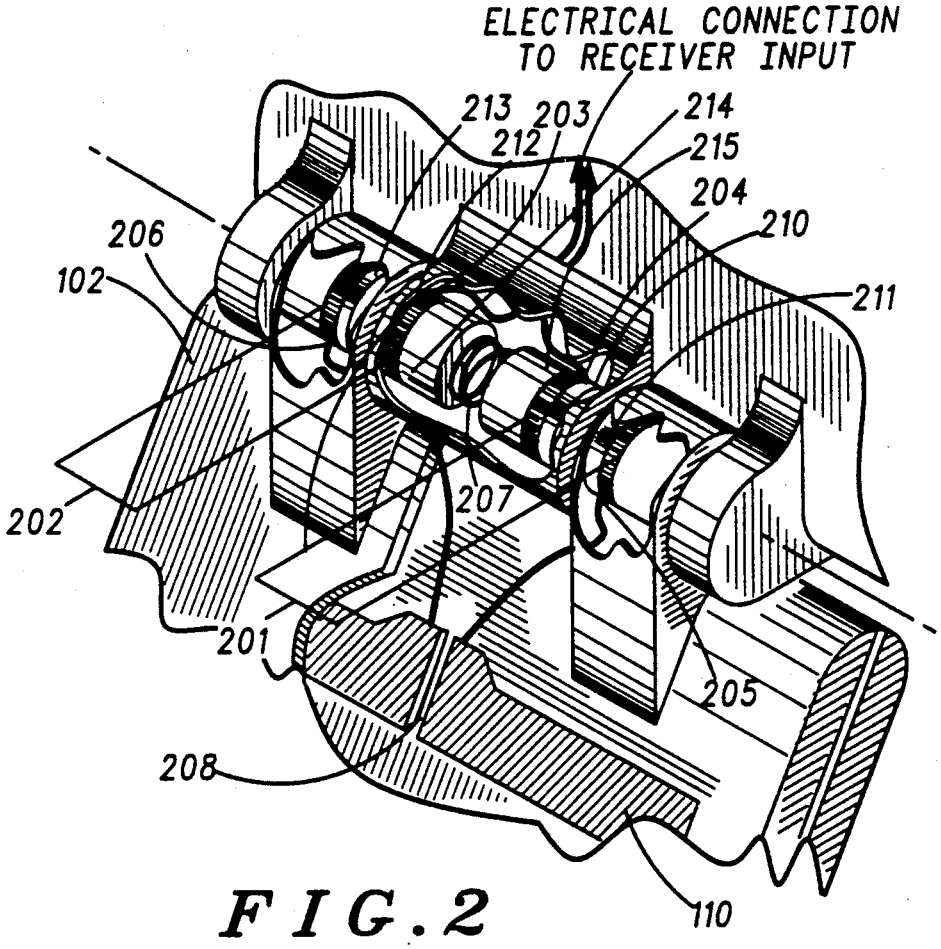
FIG. 2 shows a detailed view of the antenna coupling apparatus of the present invention coupled to an antenna in a hinged element.

Illustrated in FIG. 2 is a detailed view of the antenna/match structure of the present invention. The antenna (110) is comprised of a conductive loop with a capacitive load provided by an air gap (120). The air gap (120) is illustrated in FIG. 1. The input impedance of the antenna is matched using a matching network consisting of shunt and series capacitors. The shunt capacitance is provided by an air gap (208) at the antenna's feedpoint. The series capacitance is provided by two parallel plate capacitors (201 and 202) that also function as the contactless, rotating, coupling apparatus (103) for the RF signal passed from the antenna to the receiving apparatus located in the main body of the radiotelephone.

As illustrated in FIG. 2, the antenna coupling apparatus (103) is comprised of two sets of metal plates (201 and 202), each set forming a capacitor. The conductive plates (203–206) are coaxially located with one another, and coaxially located with the center of rotation of the mechanical hinge between the two portions of the radiotelephone. One plate from each capacitor is electrically connected to the balanced feed points of the antenna structure and mechanically affixed to the hinged portion (102) of the radiotelephone. In the preferred embodiment, the outer plates (205 and 206) of the two capacitors are the ones connected to the feed points. The inner plate of each capacitor (203 and 204) is electrically connected to the input of the receiver and mechanically affixed to the main body (101) of the radiotelephone. In an alternate embodiment, the inner plates (203 and 204) are connected to the antenna feed and the outer plates (205 and 206) are connected to the receiver inputs.

In the preferred embodiment, the inner plates (203 and 204) are free to move in the direction parallel to the hinge axis. A spring (207) is affixed to the inner plates (203 and 204) via dielectric blocks (214 and 215). Spring pressure maintains constant spacing between the plates of the capacitors (201 and 202), thus maintaining constant capacitance in spite of mechanical tolerances in the hinge assembly. The metal plates (203–206) are separated by dielectric layers.

In the preferred embodiment, the dielectric layers are each comprised of two individual slabs of dielectric (210 and 211, and 212 and 213). In each layer, one slab (210 and 212) is affixed to the inner metal plate (204 and 203) and one slab (211 and 213) is affixed to the outer metal plate (205 and 206). The dielectric slabs (210–213) define the plate spacing and prevent abrasion of the plates (203–206). In an alternate embodiment, the dielectric layers may consist of a number of dielectric slabs other than two, or of an air gap between the plates.

The spring (207) could be deleted to form an alternate embodiment in which the inner plates (203 and 204) are not free to move laterally along the hinge axis. In this case, the dielectric blocks (214 and 215) would form one solid block.

Figure 3:
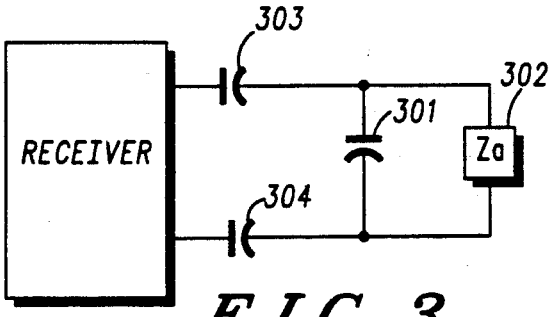
FIG. 3 shows a schematic of the electrical equivalent of the antenna coupling apparatus.

A schematic diagram of the equivalent circuit of the antenna/couple structure is illustrated in FIG. 3. The input impedance of the antenna is represented by impedance $Z_a$ (302). Capacitor (301) is the shunt capacitance. Capacitors (303 and 304) provide the series capacitance and are the capacitors of the rotating coupling apparatus.

Although the specific example of a capacitively loaded loop antenna was used for illustrative purposes, the antenna coupling apparatus of the present invention may employ any arbitrary antenna structure. Nor is the antenna coupling apparatus limited to the use of the simple shunt-series capacitive matching network used for this example. The apparatus may use a generalized matching network with an arbitrary number of components, provided that one component is a series capacitance that can be realized as the parallel-plate capacitors that comprise the rotating coupling.

In the preferred embodiment, the antenna of the present invention is connected only to the receiver of the radiotelephone. In alternate embodiments, the antenna can be connected to the transmitter also to be used as both a receive and transmit antenna.

In the preferred embodiment, the plates (203–206) are all the same size and circular in shape. This allows the hinge to rotate without changing the capacitance of the coupling. Alternate embodiments of the antenna coupling apparatus could use different sizes and shapes for the capacitor plates, depending on the series capicitance required. For example, the characteristics of the matching network may need to change to maintain antenna operability when a flip antenna is in the closed position. In this case, plates without circular symmetry could be used to generate the necessary capacitance versus rotation characteristic.

Figure 5:
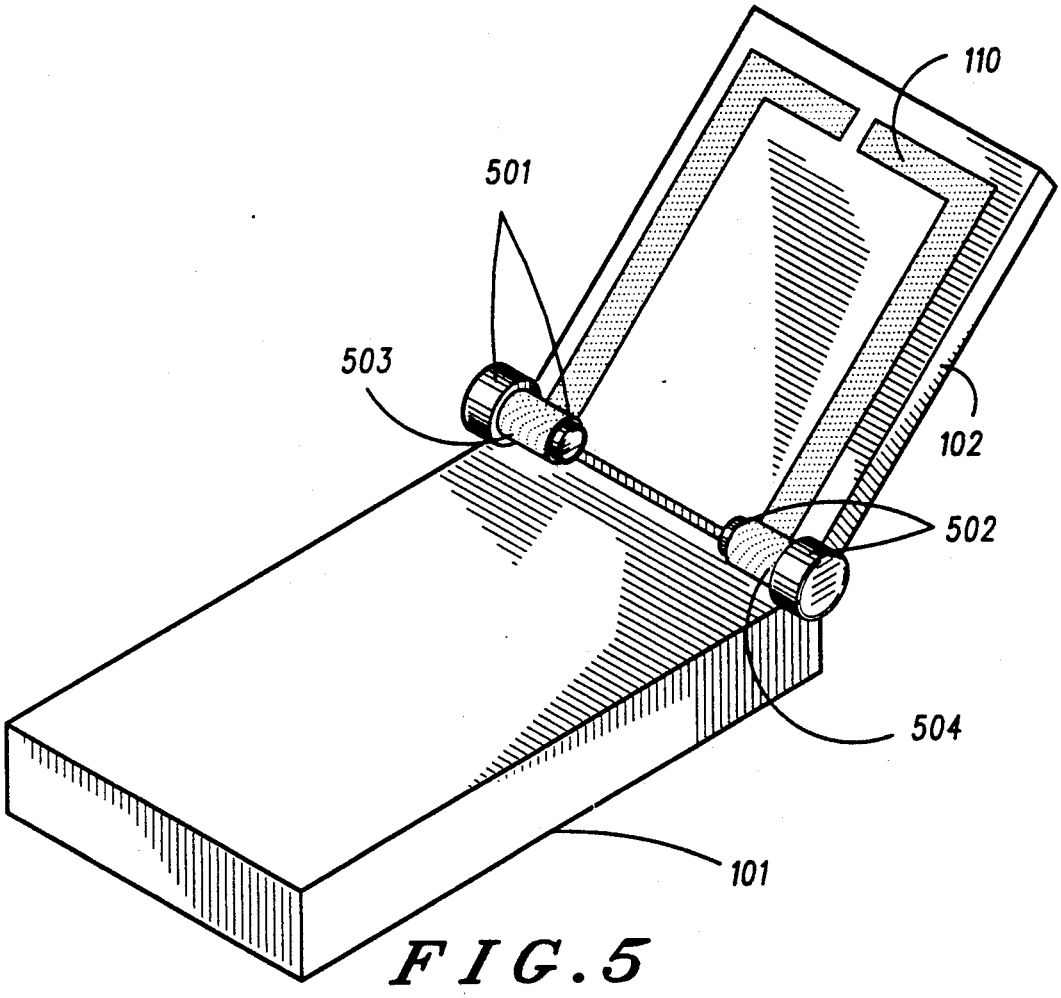
FIG. 5 shows an alternate embodiment of the present invention.

Another alternate embodiment of the present invention is illustrated in FIG. 5. The plates in this embodiment are located circumferentially in the hinge. The two circular core plates (501 and 502) that are connected to the input of the receiver are mounted to the main body (101) while the two outer plates (503 and 504) that are connected to the antenna (110) are mounted to the hinged element (102). The hinged element plates (503 and 504) have a larger circumference than the main body plates (501 and 502). This allows the main body plates (501 and 502) to rotate within the hinged element plates (503 and 504). A dielectric material is located between the outer and inner plates to prevent rubbing contact. The volume internal to plates (503) but external to plate (501) forms capacitor (303) of FIG. 3 while the volume internal to plate (504) and external to plate (502) forms capacitor (304).

The preferred embodiment uses an antenna that requires a balanced feed. Two RF connections, therefore, must be made across the hinge and two parallel-plate capacitors (201 and 202) are required. An alternate embodiment could utilize an unbalanced antenna structure. In this case, only one RF connection would be made across the hinge and only one parallel-plate capacitor would be required.

We claim:

1. An antenna coupling apparatus for a wireless communication device comprised of a main body and a hinged element, the main body and the hinged element being coupled by a hinge, the main body having transceiving means and the hinged element having an antenna, the apparatus comprising:

a first and second plate located coaxially in the hinge and coupled to the transceiving means; and a third and fourth plate located coaxially in the hinge and coupled to the antenna, the third plate capacitively coupled to the first plate and separated from the first plate by a first dielectric material, the fourth plate capacitively coupled to the second plate and separated from the second plate by a second dielectric material.

2. The antenna coupling apparatus of claim 1 wherein the first, second, third, and fourth plates are circular and have subtantially the same dimensions.

3. A radiotelephone for operating in a radiotelephone environment, the radiotelephone receiving radiotelephone signals with an antenna, the radiotelephone comprising:

receiving means for processing the received radiotelephone signals;

a main body containing the receiving means;

a hinged section containing the antenna; and hinge means for coupling the hinged section to the main body, the hinge means comprising:

a first and second plate coupled to the receiving means;

a spring for maintaining a predetermined distance between the first and second plates; and a third and fourth plate coupled to the antenna, the third plate capacitively coupled to the first plate and separated from the first plate by a first dielectric material, the fourth plate capacitively coupled to the second plate and separated from the second plate by a second dielectric material.

4. A rotating, contactless, coupling apparatus for a device comprised of a main body and a hinged element, the main body and the hinged element being coupled by a hinge, the main body having a first electrical apparatus and the hinged element having a second electrical apparatus, the coupling apparatus comprising:

a first and second plate located in the hinge and coupled to the first electrical apparatus; and a third and fourth plate located in the hinge and coupled to the second electrical apparatus, the third plate capacitively coupled to the first plate and the fourth plate capacitively coupled to the second plate.

5. A rotating, contactless, coupling apparatus for a device comprised of a main body and a hinged element, the main body and the hinged element being coupled by a hinge, the main body having a first electrical apparatus and the hinged element having a second electrical apparatus, the coupling apparatus comprising:

a first and second plate located circumferentially in the hinge and coupled to the first electrical apparatus; and a third and fourth plate located circumferentially in the hinge and coupled to the second electrical apparatus, the third plate capacitively coupled to the first plate and the fourth plate capacitively coupled to the second plate, the third and fourth plates being located at a smaller circumference than the first and second plates thus allowing the third and fourth plates to rotate within the circumference of the first and second plates.

* * * * *